United States Patent [19]

Philips

[11] Patent Number: 5,033,635

[45] Date of Patent: Jul. 23, 1991

[54] PLASTIC CONTAINER WITH HEAT SEALABLE FLANGE

[75] Inventor: Terry Philips, Willoughby, Ohio

[73] Assignee: Philips Industries Limited Partnership, Cleveland, Ohio

[21] Appl. No.: 497,228

[22] Filed: Mar. 22, 1990

[51] Int. Cl.[5] ..... B65D 41/00; B65D 73/00

[52] U.S. Cl. ..... 220/359; 206/484.2

[58] Field of Search ..... 220/359; 206/484.2, 206/217

[56] References Cited

U.S. PATENT DOCUMENTS

| | | | |
|---|---|---|---|
| 3,521,788 | 11/1968 | Kandel et al. . | |
| 3,530,917 | 9/1970 | Donovan . | |
| 3,583,125 | 6/1971 | Vermeulen . | |
| 3,672,113 | 6/1972 | Andra . | |
| 3,864,892 | 2/1975 | Molvar . | |
| 4,207,989 | 6/1980 | Ingemann | 220/359 X |
| 4,215,797 | 8/1980 | Chen | 220/359 |
| 4,231,476 | 11/1980 | Compton et al. | 206/217 X |
| 4,293,073 | 10/1981 | Yates, Jr. . | |
| 4,495,749 | 1/1985 | Faller . | |
| 4,693,385 | 9/1987 | Lamping et al. . | |
| 4,832,202 | 5/1989 | Newman et al. | 206/217 |
| 4,865,217 | 9/1989 | Yoshimoto | 220/359 |

FOREIGN PATENT DOCUMENTS

| | | | |
|---|---|---|---|
| 2213125 | 8/1989 | United Kingdom | 220/359 |

*Primary Examiner*—William I. Price

*Attorney, Agent, or Firm*—Fay, Sharpe, Beall, Fagan, Minnich & McKee

[57] ABSTRACT

A container, especially a food container, has straight, frustoconical side walls to give it resistance to vertical loads. A bottom is recessed upward from the bottom edge of the side wall. At the top, a flange extends radially outward. The flange is textured with grooves formed by mold machining marks to enhance bonding between the container and a flexible sheet material used to close the container. Spacers project outward from near the top of the container to permit several containers to be stacked without getting stuck to each other. The spacers have a T-shape, with the head of the T being integral with the side wall and the leg of the T forming an outwardly projecting rib.

10 Claims, 1 Drawing Sheet

PLASTIC CONTAINER WITH HEAT SEALABLE FLANGE

FIELD OF THE INVENTION

The present invention relates to plastic containers and particularly to injection molded containers for use in the food industry.

BACKGROUND OF THE INVENTION

In the past food products have been packaged in injection molded plastic containers. These containers are manufactured at an injection molding plant and shipped empty to a food processing facility. There the containers are filled and a flexible sheet is sealed in place to close their tops. The filled containers are then packaged and shipped to restuarants or retail food outlets.

At the injection molding plant empty containers for food products must be conveniently stackable in a nested condition. The draft angle required to ease an injection molded container from the mold members in which it is formed contributes as well to easy stacking of the finished container. It is known to provide spacers which project outwardly from containers to keep a predetermined minimum amount of space between nested containers. Spacers which are stable can support a large stack of containers, and thus can be shipped and handled more economically.

Food containers have been provided with flanges at their open ends, and a flexible sheet material has been welded or heat sealed across the open end for the usual hygenic reasons. When the food within is to be served or eaten, the sheet may be either cut away or peeled from the top of the container, depending on how it is welded or heat sealed into place.

There are two techniques conventionally used to seal a sheet material to the top of a container. In one process, the sheet is streched across the top of the container including the surrounding flange. Then a hot ring (or rings) is pressed against the sheet and the heat welds the sheet to the flange. In this case the ring is relatively narrow compared to the width of the flange so one or more concentric circles of welded or heat fused areas are created. Generally, sheets attached in this manner must be cut to gain access to the food within because these welds cannot be peeled apart.

The second type of sealing process is similar except that a lower heat is applied over a wider area, typically the entire surface of the flange. When the sheet is sealed in place with this technique, it generally can be peeled off the flange to open the container. Regardless of which welding technique is used, occassionally the seal is not sufficient. When this occurs the container and the food within must be discarded as waste. Therefore, any steps which promote good seals with a minimum of welding time would advance the art.

Once a container has been filled with a product and its top sheet sealed in place, the container is placed four to a square pallet or box, and the pallets are stacked for shipment. The pallets or boxes are frequently stacked one on top of another and then packed on a truck or railroad car using a forklift. Containers which can withstand greater compressive loads without collapsing can be stacked higher and will withstand rougher handling.

SUMMARY OF THE INVENTION

The present invention provides an injection molded container with spacers of good stability to permit greater stacking heights when the container is empty. In addition a flange at the top perimeter of the container is textured to enhance welding of a cover sheet in place, and this reduces waste and the time necessary to complete a weld. Further, the container has a geometric configuration which increases its strength to resist vertical loads, and so it can be stacked higher than comparable prior art food containers.

The present invention comprises an injection molded container with a side wall, a bottom wall and a radial flange extending from a top, open end of the container. The side wall tapers, and similar containers may be stacked one inside another. Spacers project radially outward from the side wall near the flange. The spacers are positioned to keep the stacked containers from touching each other or sticking together. The spacers each include a rib which projects out from a base or boss molded in the side wall of the container the entire length of the rib. The base shortens the effective height of the rib and thus stablizies it against lateral deflection.

The present invention also comprises such a container in which the flange is textured to enhance welding a flexible sheet material to it to close the top of the container. To this end the top surface of the container is formed with essentially concentric grooves between 0.001 and 0.010 inch deep spaced so that the entire surface is textured.

The present invention further comprises a container formed by a tapered, straight side wall which has top and bottom edges. A flange extends radially outwardly from the top edge of the side wall, while a bottom wall closes the bottom of the container, recessed upward from the bottom edge. With this design, vertical loads applied to the flange are transferred directly to the bottom edge of the side wall which is free of any curves to cause premature buckling.

The invention then comprises the features hereinafter described and particularly pointed out in the claims, the following description and annexed drawing setting forth in detail an illustrative embodiment of the invention which is indicative of but one of the various ways in which the invention may be embodied.

DETAILED DESCRIPTION

Figure 1:
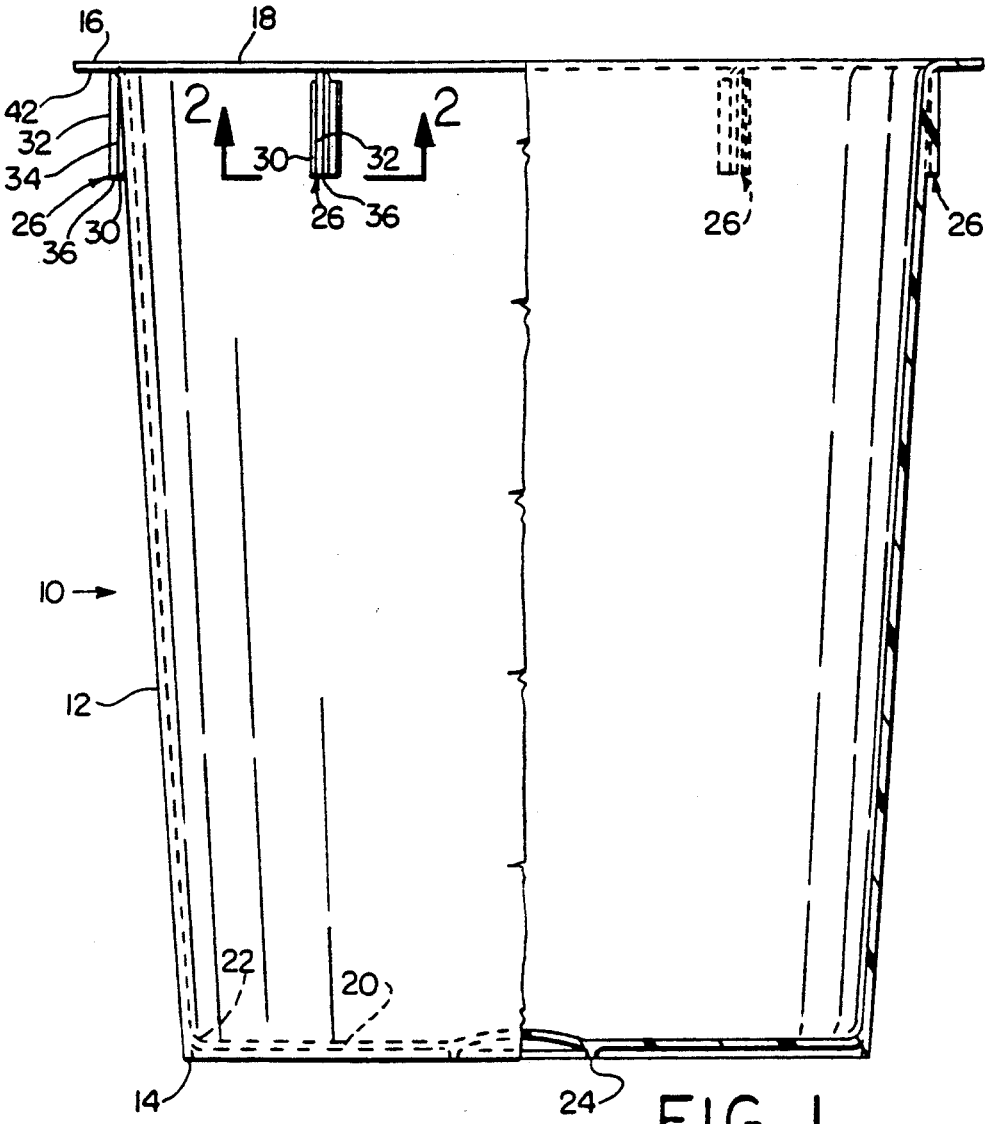
FIG. 1 is an elevation view, partially broken away in cross section, of a container constructed in accordance with the present invention to which a sheet of flexible material has been heat fastened.

The container 10 (FIG. 1) is formed from the injection molded plastic. In one embodiment high density polyethylene (HDPE) is used, but other plastic materials could be used as well. The container 10 is intended principally as a food container, and it is proportioned to fit in the openings of a conventional food service work station such as may be found in institutional kitchens or fast food restuarants.

The container 10 has a straight, frustoconical side wall 12. Typically the side wall 12 forms an angle of 2°-5° to the center axis of the container and is between 0.02 and 0.06 inch thick. Preferably the side wall of a 1.3 gallon container has a draft angle of 3°30′ and a thickness of 0.04 inch.

At its lower end the side wall 12 terminates in an annular end face 14. At its top end, the side wall 12 blends into a flange 16. The flange 16 extends radially outwardly from the side wall in a plane perpendicular to the center axis of the container. Typically the flange has a thickness between 0.03 and 0.08 inch and a radial width between ¼ inch and 1 inch. In the illustrated 1.3 gallon container the flange is 0.045 inch thick and about ½ inch wide with an outer diameter of 8 inches for a total container height of 8½ inches.

When the container is placed in a circular opening of a food service work station, the container and its contents may be supported at the flange 16, at its side wall with a wedge-fit in the opening, or at the bottom end face 14 of the side wall, depending on the relative dimensions of the container and the work station opening and design. As discussed more fully below, when filled with food, the container 12 may be sealed by flexible sheet 18 which is heat sealed or welded to the flange 16.

The container 10 is closed at its bottom end by a bottom wall 20. This bottom wall 20 is recessed upward from the end face 14 of the side wall 12 and is joined to the side wall by a small radius curve 22. In a 1.3 gallon container, the end face 14 is approximately 6⅛ inches in diameter, the curve 22 has about a 3/16 inch radius, the bottom wall has a thickness of 0.05 inch, and the bottom wall is recessed 0.06 inch in relation to the bottom end face 14 of the side wall. The bottom wall 20 also includes a small circular wall 24 formed by the gate for feeding molten plastic into the injection mold. This circular wall 24 is trimmed flush with the plane of the circular end face 14.

The straight side wall 12 and its circular end face 14 form an efficient and strong system for supporting vertical loads. When a vertical load is applied to the top of the container 10 (for example, during handling or when stored in a stack) the load is transmitted through the side wall 12 to end face 14 almost entirely as a compressive force. Only a small component of the vertical force is tranverse to the side wall 12, and thus any tendency to buckle is greatly reduced, especially as compared to side walls that are not straight. The illustrated 1.3 gallon container has been found to support loads in excess of 500 pounds before failure.

Figure 2:
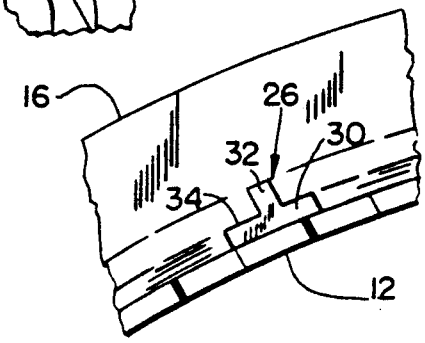
FIG. 2 is a view looking in the direction of arrows 2—2 of FIG. 1.

The container 10 also includes spacers 26 (FIGS. 1 and 2) which permit a number of containers 10 to be stacked in a nested arrangement (FIG. 3) without sticking together. The spacers 26 extend downward from the underside of the flange 16. Typically there are six spacers 26, although more or fewer could be provided. The spacers 26 each include a base or boss 30 and a rib 32 which projects outward from the base.

Figure 3:
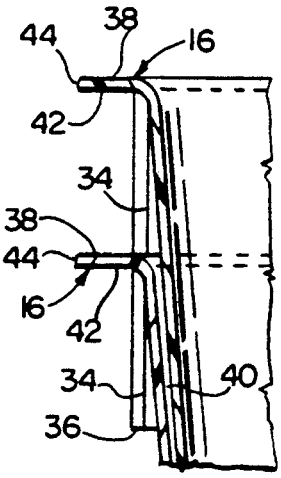
FIG. 3 is a partial sectional view showing two containers like that of FIG. 1 in a stacked or nested arrangement.

The base 30 is a wedge shape solid that is generally rectangular in front view. In side view the base tapers going from bottom to top. The taper of the base 20 complements the angle of the side wall 12 so that the outer face 34 of the base is parallel to the centerline of the container. Preferably, the base at its upper end is flush with and thereby blended into the outer surface of the side wall as shown in FIG. 3.

The rib 32 is a rectangular solid which extends radially outward, parallel to the axis of the container 12. Viewed from below (FIG. 2) the rib 32 and base 30 form a T shape with the head of the T against the side wall 12 and the leg of the T extending outward. By shaping the spacer 26 in this way, wall thicknesses are kept to a minimum. This reduces problems caused by uneven shrinkage of HDPE. At the same time the radial length of the rib 32 is kept to a minimum, and so it is stable and resists sideways deflection.

The rib 32 terminates at its lower end in an end surface 36. As shown in FIG. 3, when containers 10 are stacked, the end surface 36 of one container rests on the top face 38 of the flange 16 of the subjacent container. The vertical length of the rib 32 and its base 30 are selected so that a small space 40 remains between the side walls of the stacked containers, thus to assure that they can be easily separated when they are to be filled or used. In the illustrated 1.3 gallon container, the rib has a length of 0.875 inch, a thickness of about 0.05 inch and a radial projection beyond the side wall at its lower end of ⅛ inch. The base has a width of about ¼ inch in the 1.3 gallon container.

Once a container 10 has been molded, it is stacked and shipped to a user, in one particular case, a food processor. The food processor unstacks the containers, fills them with food product, in particular pickle chips, and then seals them. Sealing is accomplished by welding or heat sealing the flexible sheet 18 to the flange 16 in the conventional manner discussed above. This process results in the sheet being permanently or semipermanently fused or adhered to the flange of the container 10.

The flexible sheet material may be conventional sealing sheet such as LC FLEX 30610 sold by Jefferson Smurfit Corporation, Alton, Ill. This product is typical of laminate sealing sheets, the sheet including a nylon layer with a layer of polyethylene and a layer of a product sold by the same company under the mark SCLAIR. It is believed that the polyethylene acts as a thermoplastic adhesive melting into and perhaps chemically bonding or fusing with the HDPE of which the container 10 is formed.

The mold in which container 10 is formed has its parting line even with the bottom surface 42 of the flange 16. This is done to provide a smooth corner 44 at the top outside perimeter of the flange 16 by assuring that any flash which might develop in the molding process is below the corner 44.

Figure 4:
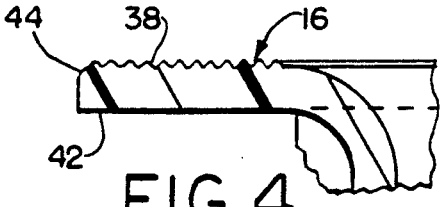
FIG. 4 is an enlarged view of a portion of FIG. 3.

The flange 16 is specially adapted to facilitate and enhance welding or heating sealing the sheet 18 to the flange. The flange 16 is provided with grooves or ridges on its top face, as shown in FIG. 4. The grooves are formed by rough machining grooves left in the mold cavity; they are essentially concentricc rings between about 0.001 and 0.01 inch deep and preferably about 0.002 inch deep. The grooves are closely spaced as at a spacing of between about 0.001 and 0.04 inch and preferably at a spacing of of about 0.01 inch.

The presence of the rough, textured surface formed by such grooves greatly enhances the welding or heat sealing process. The result is that a container 10 made with such a textured surface 38 can be sealed using a lower temperature, and/or a shorter time for welding-/heat sealing, and the welds or seals so produced are more reliable. Processing time is therefore reduced and there is less waste due to incomplete welds. A typical temperature is 350° F. and a typical pressure is 40 pounds/square inch.

What is claimed is:

1. A container molded from a plastic material having a straight frustoconical side wall defining a top and bottom edge of the container, a bottom wall recessed from the bottom edge of the container and connected to the side wall, a radially projecting annular flange extending from the top edge of the container, said flange including annular surface means for sealingly contacting a flexible sheet material to close the container, and the annular surface means including texture surface means for enhancing a bond between the sheet material and the flange.

2. The container of claim 1, wherein the texture surface means includes a plurality of annular grooves.

3. The container of claim 1, including a flexible sheet material closing the top of the container, the sheet material being heat sealed to said flange.

4. The container of claim 3, wherein the sheet material includes a thermoplastic adhesive for securing the sheet material to the flange.

5. A container molded from a plastic material having a straight frustoconical side wall defining a top and bottom edge of the container, a bottom wall recessed from the bottom edge of the container and connected to the side wall, a radially projecting annular flange extending from the top edge of the container, said flange including annular surface means for sealingly contacting a flexible sheet material to close the container, the sheet material including a thermoplastic adhesive for securing the sheet material to the flange, and the annular surface means including texture surface means for facilitating heat sealing of the sheet material to the flange.

6. The container of claim 5, wherein the texture surface means includes grooves in the flange, the groove being 0.001 to 0.010 inch deep.

7. The container of claim 5, wherein the texture surface means includes grooves in the flange, the grooves being about 0.002 inch deep.

8. A plastic container comprising a bottom wall, an annular side wall having a top edge, and an annular flange extending radially outwardly from the top edge of said side wall, said flange having a textured top surface means for sealingly contacting a flexible sheet material to close the container.

9. The container of claim 8, wherein the textured top surface means includes closely spaced annular grooves formed in the flange during molding of the container.

10. The container of claim 9 including a flexible sheet material heat sealed to the flange at the textured top surface means.

* * * * *